US005331892A

United States Patent [19]

Seib et al.

[11] Patent Number: 5,331,892

[45] Date of Patent: Jul. 26, 1994

[54] DEVICE FOR FEEDING PRINTING PLATES ONTO THE PLATE CYLINDER OF PRINTING MACHINES, ESPECIALLY SHEET-FED OFFSET PRINTING MACHINES

[75] Inventors: Berthold Seib, Rodgau; Georg Hartung, Seligenstadt; Helmut Schild, Steinbach/Tannus, all of Fed. Rep. of Germany

[73] Assignee: Man Roland Druckmaschinen AG, Fed. Rep. of Germany

[21] Appl. No.: 64,752

[22] Filed: May 18, 1993

[30] Foreign Application Priority Data

May 18, 1992 [DE] Fed. Rep. of Germany ..... 4215969

[51] Int. Cl.[5] ..... B41L 47/14

[52] U.S. Cl. ..... 101/477; 101/415.1

[58] Field of Search ..... 101/477, 415.1, 474

[56] References Cited

U.S. PATENT DOCUMENTS 4,285,275 8/1981 Sato ..... 101/474

5,127,328 7/1992 Wieland ..... 101/415.1

5,218,907 6/1993 Komori et al. ..... 101/477

*Primary Examiner*—Edgar S. Burr

*Assistant Examiner*—Anthony H. Nguyen

*Attorney, Agent, or Firm*—Leydig, Voit & Mayer, Ltd.

[57] ABSTRACT

A device for introducing printing plates more simply into the opened gripping region of a tension rail assigned to the print start of a plate cylinder. The device includes an introduction rail extending over the format width of the plate cylinder and adapted to be moved against the outer circumference of the plate cylinder into a specific angular position in the region of the print start. When the introduction rail is so positioned, the front edge of the printing plate may be introduced directly into the gripping region of the print-start tension rail via an introduction face formed on the introduction rail. The outer circumference of the plate cylinder coacts with the introduction face of the introduction rail to define a funnel-shaped region for receiving the front edge of the printing plate just prior to the latter being inserted into the tension rail.

9 Claims, 2 Drawing Sheets

DEVICE FOR FEEDING PRINTING PLATES ONTO THE PLATE CYLINDER OF PRINTING MACHINES, ESPECIALLY SHEET-FED OFFSET PRINTING MACHINES

BACKGROUND OF THE INVENTION

This invention relates to a device for feeding printing plates onto the plate cylinder of a printing machine.

In certain types of sheet-fed offset printing machines, a printing plate is fastened on the plate cylinder by means of two tension rails located in a channel in the cylinder and assigned respectively to the print-start region and to the print-end region of the plate. Initially, the print-start region of the printing plate is inserted into and clamped within the gripping region of the corresponding tension rail. Thereafter, the print-end region of the plate is likewise clamped in the corresponding second tension rail, the plate then being tensioned by the exertion of force. When large-format printing plates are used, the introduction of the print-start region of the printing plate into the corresponding print-start tension rail is very laborious and time-consuming since the corresponding edge of the printing plate has to be introduced over its entire width into a sometimes very narrow slot of the gripping region. A waviness of the print-start edge of the printing plate makes this situation even worse. Also, during the operation of drawing on the printing plate, that is to say during the slow forward run of the plate cylinder, and during the drawing off of an old printing plate upon backward running of the cylinder, the printing plate has to be held or supported so as not to rest with its printing side on any machine parts or else the plate may be damaged.

German Patent Specifications Nos. DE 3,940,795-C2 and DE 3,940,796-C2 and European Patent Specification No. EP 0,431,575-A2 disclose systems for an automatic printing plate change in which the drawing off of an old printing plate from and the feeding of a new printing plate to the plate cylinder take place automatically. In addition to storage and reception regions for the printing plates, these systems also have transport devices for feeding the printing plates and conveying them away. These systems, however, are of complex construction and are therefore relatively expensive.

A semi-automatic printing plate changing system in which a new printing plate is fed to the plate cylinder from a position located on an upwardly pivotable guard in front of the printing-unit cylinder is also known from Japanese Patent Specification No. JP-A-59-22755. Page 6 of the February, 1992 issue of "Der Polygraph" ["The Polygraph"] and Japanese Patent Specification No. JP-A-63-191636 disclose semi-automatic printing plate changing systems in which the plate cylinder has devices for clamping the print-start region and the print-end region of the printing plate and for then tensioning the plate. Also provided are devices by which the printing plate can be drawn onto the plate cylinder with simpler handling techniques. The device disclosed in the last-mentioned Japanese Patent Specification provides, in particular, a pivotably mounted press-down roller which can be advanced up to the outer circumference of the plate cylinder and with which the print-end region of the printing plate is introduced into the corresponding print-end tension rail. However, a device for substantially simplifying the operation of introducing the front edge of the printing plate into the corresponding tension rail is not known.

SUMMARY OF THE INVENTION

The general object of the present invention is to effect the introduction of the printing plate front edge into the corresponding print-start tension rail in a relatively simple manner and with a comparatively low cost construction.

A more detailed object is to achieve the foregoing through the provision of an introduction rail having an introducing face which may be located against the outer circumference of the plate cylinder to facilitate introduction of the front edge of the printing plate into the opened gripping region of the corresponding tension rail.

More specifically, the introduction rail is mounted so that it can be moved against and moved away from the outer circumference of the plate cylinder, the rail extending over the format width of the cylinder. The cylinder is rotated into a position in which the introduction rail of the invention may be set against the region of the bevel of the print start of the cylinder. The introduction rail includes a face extending over its entire length and configured to coact with the corresponding outer circumference of the cylinder to define a funnel-shaped introduction region which opens exactly into the gripping region of the opened print-start tension rail of the cylinder. The new printing plate to be fed thus need only be pushed into the introduction region and is introduced into the opened print-start tension rail virtually automatically by the face of the introduction rail on the one hand and by the outer circumference of the plate cylinder on the other hand. The print-start tension rail then may be actuated so as to close its gripping region and clamp the printing plate.

According to a more specific aspect of the invention, the introduction rail may be arranged pivotably about an axle which is located on a guard in front of the printing-unit cylinders and substantially level with the plate cylinder of the printing unit. The introduction rail is advantageously formed as the lower free end of an approximately arcuately profiled sheet metal section which extends over the format width of the plate cylinder. To protect the printing plate during the introduction, brushes can be arranged on the concave side of the sheet metal section to support the printing side of the plate.

The pivoting of the introduction rail or sheet metal section toward and away from the cylinder may be effected, for example, by means of two pneumatic cylinders which are preferably located on the frame side walls of the printing machine, the piston rods of the cylinders acting on the sheet metal section for purposes of pivoting the latter.

These and other objects and advantages of the invention will become more apparent from the following detailed description when taken in conjunction with the accompanying drawings.

DETAILED DESCRIPTION OF THE PREFERRED EMBODIMENT

Figure 1:
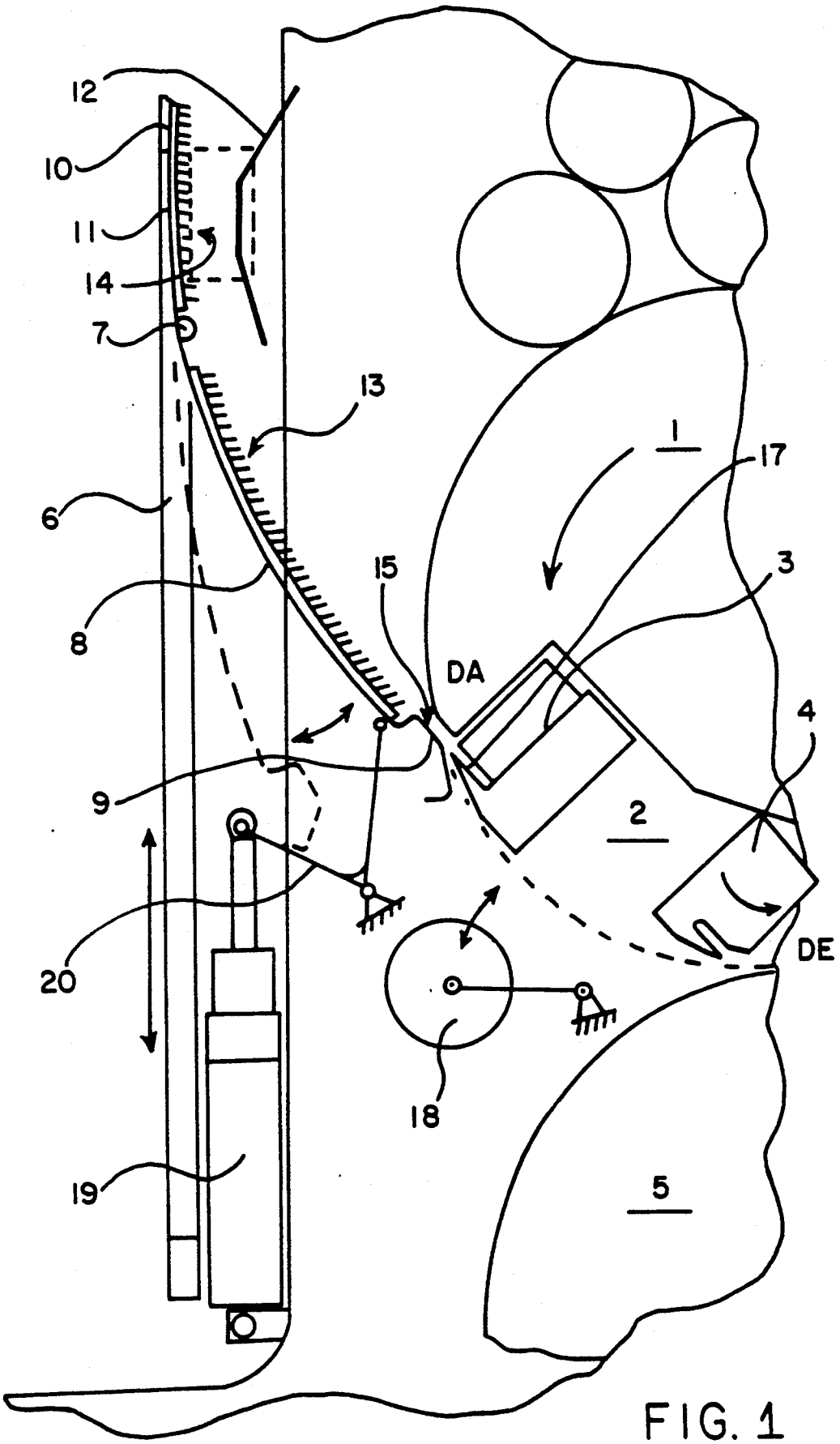
FIG. 1 is a sectional view of the device according to the invention installed in a typical printing unit.

FIG. 1 schematically shows, in section, part of a printing unit of a printing machine of in-line design. Mounted between the two frame side walls of the printing unit is a plate cylinder 1 which has, in a channel or cylinder pit 2, a pair of tension rails 3 and 4 assigned to the print start DA and to the print end DE, respectively, of a printing plate (not shown). Above the plate cylinder 1 are located the rollers of an inking unit, there being two ink applicator rollers shown in FIG. 1. Before a printing plate is changed, the rollers are retracted from the cylinder in a known way.

A guard 6 is located in an active position during the printing operation and is movable along a guide rail attached to each frame side wall of the printing unit. The guard 6 normally is positioned in front of the printing unit and shields the plate cylinder 1 and a rubber-blanket cylinder 5 arranged under the plate cylinder. For access to the printing-unit cylinders, particularly in order to change the rubber-blanket cylinder, the guard 6 may be pushed upwardly along the guide rails as indicated by the vertical arrow. The guard 6 extends over the width of the printing unit.

Preferably attached to an upper part of the guard 6 is a pivot axle 7 upon which a sheet metal section 8 is suspended. The sheet metal section 8 has a slight curvature and has the same width as the format width of the plate cylinder 1. In accordance with the invention, there is attached to the free end of the sheet metal section 8 an introduction rail 9 which, by swinging the sheet metal section 8 about the axle 7, may be pivoted against the outer circumference of the plate cylinder 1 or swung away from the cylinder as indicated by the arrow adjacent the sheet metal section. In the embodiment illustrated in FIG. 1, the introduction rail 9 is formed by appropriately profiling of the free end portion of the sheet metal section 8.

Attached to an upper cross member 10 of the guard 6 is a guide plate 11 which extends downwardly almost as far as the top edge of the sheet metal section 8 and approximately to the same level as the pivot axle 7. Opposite the guide plate 11, a guide plate 12 is likewise attached to the guard 6 and is formed with two bent legs. The guide plates 11 and 12 extend over the width of the guard 6 and over the format width of the plate cylinder 1, respectively, and form a gap for guiding the printing plate. A side stop which may be adjusted according to the format of the printing plate may also be provided in the gap.

Figure 2:
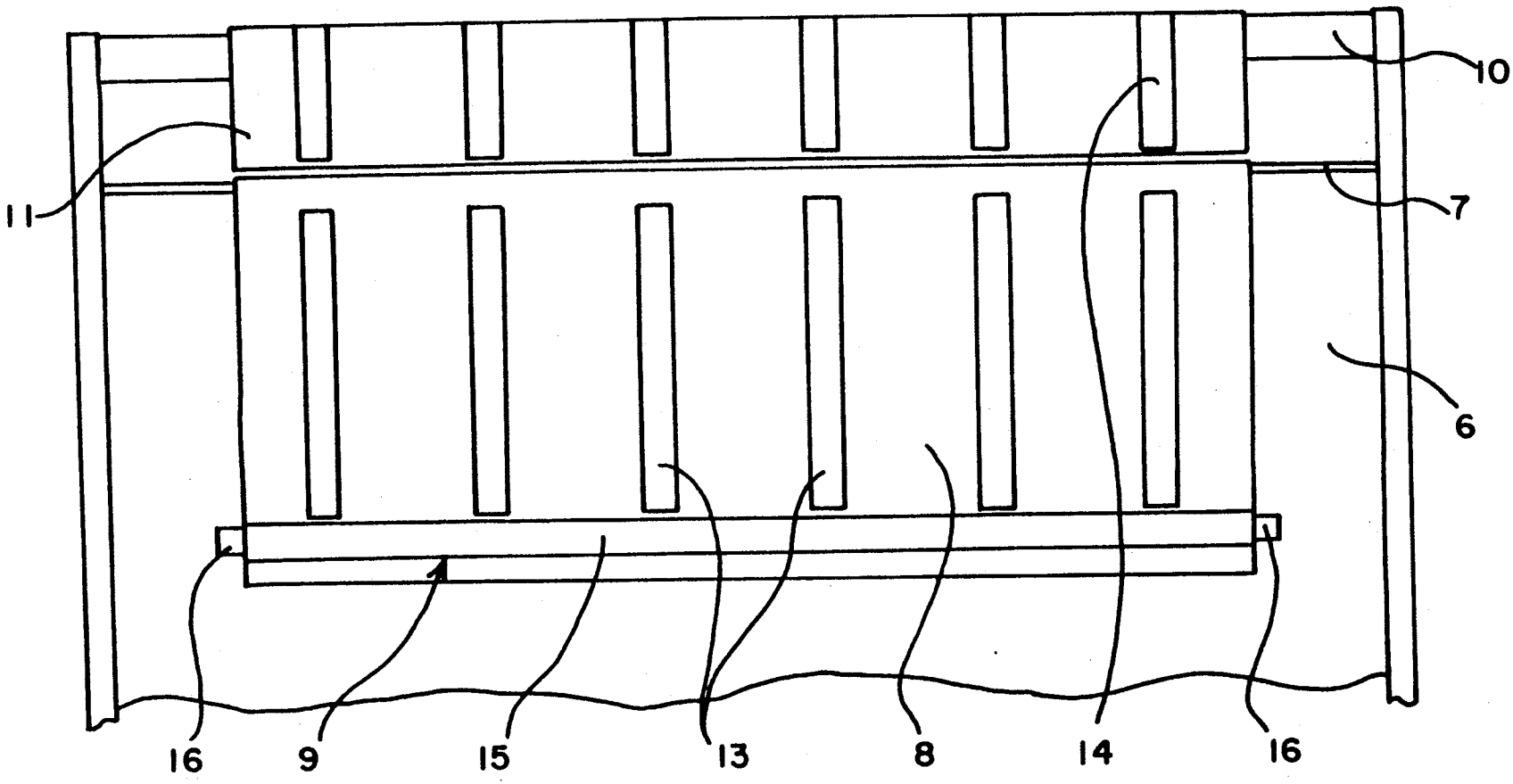
FIG. 2 is an elevational view of the introduction rail, together with the sheet metal section, over the format width of the plate cylinder.

FIG. 2 is an elevational view of the sheet metal section 8 and the introduction rail 9. Spaced laterally from one another on the concave inner face of the curved sheet metal section 8 is a plurality of strips in the form of brushes 13 whose bristles support the printing side of the printing plate. Brushes 14 are likewise attached to the guide plate 11 of the cross member 10 for the protective support of the printing plate. While the brushes 13 and 14 are preferred, other devices can also be provided for the scratch-free and wear-free support of the printing plate.

The introduction rail 9 on the free end of the sheet metal section 8 is formed with a generally C-shaped profile as shown in FIG. 1 and includes an introduction face 15 which is disposed in opposing relation with the plate cylinder 1 and which is located approximately level with the bristles of the brushes 13.

To introduce a new printing plate, the sheet metal section 8 is pivoted against the plate cylinder 1 as shown in FIG. 1 after the cylinder has been rotated into the position illustrated. Stops 16 (FIG. 2) are located on the two ends of the introduction rail 9 for supporting the rail on each of two bearer rings or measuring rings of the plate cylinder 1. The stops 16 serve to space the introduction rail 9 in relation to the print start DA of the plate cylinder 1 in such a way that the introduction face 15 of the rail is aligned with the opened gripping region 17 of the tension rail 3. To avoid damage to the bearer rings, the stops 16 may, for example, be polyamide blocks. The stops also may be adjustable.

A new printing plate to be fed is introduced from the top side of the guard 6, through and between the guide plate 11 and the opposite guide plate 12, and directly into the tension rail 3 while being supported on the sheet metal section 8 by means of the brushes 13. As shown in FIG. 1, the introduction face 15 of the introduction rail 9 coacts with the outer circumference of the plate cylinder 1 in the region of the print start DA to define a funnel which extends over the format width of the plate cylinder 1 and which insures that the front edge of the printing plate can be introduced directly into the gap-like gripping region 17.

After the printing plate has been introduced into the front tension rail 3 and the latter has clamped the print-start edge portion of the printing plate as a result of closing of the gripping region 17, the sheet metal section 8 together with the introduction rail 9 may be pivoted away from the plate cylinder 1. The plate cylinder then is slowly rotated forwardly via a corresponding activation of the main drive of the printing machine, the printing plate being drawn around the outer circumference of the plate cylinder 1. In FIG. 1, there is shown a press-down roller 18 which is mounted so that it can be advanced toward and retracted from the plate cylinder 1. The roller 18 presses the printing plate against the outer circumference of the plate cylinder as the plate is drawn onto the cylinder. The press-down roller 18 extends over the entire format width and can be advanced and retracted, for example, by means of two bearing levers (one on each frame side wall of the printing machine) which are adapted to be pivoted by pneumatic cylinders. As is known from the state of the art, a press-down roller 18 of this type can also introduce the trailing end of the printing plate into the correspondingly designed print-end tension rail 4. The tension rail 4 is then closed via remotely actuatable devices in the plate cylinder.

For pivoting the sheet metal section 8 and the introduction rail 9 toward and away from the plate cylinder 1, there is attached, for example, to each of the two frame side walls of the printing machine a pneumatic cylinder 19 which causes the corresponding pivoting of the sheet metal section 8 by means of a respective bell-crank 20 mounted on the frame. Of course, the pneumatic cylinders 19 may also be mounted directly in the guard 6 and be pivotally connected directly to the sheet metal section 8.

The device according to the invention is suitable not only for feeding a new printing plate to the plate cylinder 1 but also for removing the printing plate located on the plate cylinder. When the sheet metal section 8 together with the introduction rail 9 are retracted to the inactive position indicated by broken lines in FIG. 1, the plate cylinder 1 may be rotated backwardly with the tension rail 4 opened and with the press-down roller 18 engaging the printing plate. In this way, the printing plate may be conveyed out between the guide plates 11 and 12 on the guard 6 while being supported by the brushes 13 of the sheet metal section 8.

We claim:

1. A device for feeding a printing plate onto the plate cylinder of a printing machine and especially a sheet-fed offset printing machine, the plate cylinder having a channel and a print start region, a tension rail located in said channel adjacent said print start region and having an openable and closable gripping region for receiving a front edge of the printing plate, the gripping region being in the form of a gap extending over the format width of the plate cylinder and opening substantially tangentially with respect to the outer circumference of the cylinder, a sheet metal section extending over the format width of the print cylinder, said device being characterized by an introduction rail on said sheet metal section and extending across the format width of the plate cylinder, means supporting said introduction rail for movement between retracted and active positions, said introduction rail engaging the outer circumference of the plate cylinder in the vicinity of the print start region when said introduction rail is in said active position, said introduction rail having an introduction face which, when said introduction rail is in said active position, coacts with the plate cylinder to define a second gap aligned with the gap of the opened gripping region of said tension rail and guiding the front edge of the printing plate into the opened gripping region.

2. A device according to claim 1 in which said means comprise a pivot axle extending parallel to the axis of the plate cylinder and pivotally mounting said introduction rail for movement between said retracted and active positions.

3. A device according to claim 2 further including a guard attached to said pivot axle and positioned in front of said plate cylinder, said guard being linearly movable to a position exposing said cylinder.

4. A device according to claim 2 in which said sheet metal section is pivotally supported by said pivot axle, said introduction rail being on the free end of said sheet metal section.

5. A device according to claim 4 in which said sheet metal section has a curvature in a direction of transverse to the format width and is attached to said pivot axle with the concave side of the curvature facing the plate cylinder.

6. A device according to claim 4 in which the introduction face of said introduction rail is defined by a profiled region of the free end of said sheet metal section.

7. A device according to claim 4 further including brushes attached on the side of the sheet metal section facing the plate cylinder, said brushes supporting the printing plate to be fed on its printing side.

8. A device according to claim 1 further including stops attached to the ends of the introduction rail, said stops supporting the introduction rail on bearer rings of the plate cylinder when said introduction rail is in said active position.

9. A device according to claim 1 further including a pneumatic cylinder attached to the printing machine and the introduction rail and operable to move the introduction rail between said retracted and active positions.

* * * * *